US006338164B1

(12) United States Patent
Howard

(10) Patent No.: US 6,338,164 B1
(45) Date of Patent: Jan. 15, 2002

(54) PROTECTIVE CHAPS

(76) Inventor: David A. Howard, 325 Bogert Ave Lobby C #1106, Toronto Ontario (CA), M2N-1L8

( * ) Notice: Subject to any disclaimer, the term of this patent is extended or adjusted under 35 U.S.C. 154(b) by 0 days.

(21) Appl. No.: 09/797,627

(22) Filed: Mar. 5, 2001

(51) Int. Cl.[7] ..... A41D 13/00
(52) U.S. Cl. ..... 2/242; 2/23
(58) Field of Search ..... 2/242, 455, 16, 2/22–24, 911, 227, 463, 466, 115, 2.5, 79, 229; 602/62, 23

(56) References Cited

U.S. PATENT DOCUMENTS 2,355,193 A 8/1944 Walker
4,280,342 A 7/1981 Eng et al.
4,984,303 A 1/1991 Ross
5,095,544 A 3/1992 Elverskog
5,101,511 A * 4/1992 Elverskog ..... 2/2.5
5,123,120 A * 6/1992 Ross ..... 2/229
5,375,262 A * 12/1994 Carter ..... 2/23
D373,892 S 9/1996 Landwehr
5,611,081 A 3/1997 Torres
6,131,195 A * 10/2000 Foreman ..... 2/22

* cited by examiner

*Primary Examiner*—John J. Calvert
*Assistant Examiner*—Tejash D Patel

(57) ABSTRACT

Protective chaps for protecting the shins, knees, feet and chest of a wearer. The protective chaps include first and second leg portions adapted to fit over trousers of a user. Each of the leg portions has a knee portion, and a shin portion. Each of the leg portions is integrally coupled to and extends away from a waist portion. Each of a plurality of pockets is securely coupled to one of the first and second leg portions. A first and second of the pockets is securely coupled to one of the knee portions. A third and fourth of the pockets is securely coupled to one of the shin portions. Each of a plurality of padding members is removably positionable in one of the pockets such that each of the pockets has one of the padding members therein. A primary strap member removably secures the waist portion to the body of a user. A back side of the primary strap member is securely attached to and extends along a top edge of the waist portion. Each of a plurality of secondary strap members removably secures each of the leg portions to one of the legs of a user. Each of the secondary strap members is securely coupled to one of the first and second leg portions.

16 Claims, 5 Drawing Sheets

PROTECTIVE CHAPS

BACKGROUND OF THE INVENTION

1. Field of the Invention

The present invention relates to chaps and more particularly pertains to new protective chaps for protecting the shins, knees, feet and chest of a wearer.

2. Description of the Prior Art

The use of chaps is known in the prior art. More specifically, chaps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,095,544; 2,355,193; U.S. Pat. No. Des. 373,892; U.S. Pat. Nos. 5,611,081; 4,984,303; 4,280,342.

While these devices fulfill their respective, particular objectives and requirements, the aforementioned patents do not disclose new protective chaps. The inventive device includes first and second leg portions adapted to fit over trousers of a user. Each of the leg portions has a knee portion, and a shin portion. Each of the leg portions is integrally coupled to and extends away from a waist portion. Each of a plurality of pockets is securely coupled to one of the first and second leg portions. A first and second of the pockets is securely coupled to one of the knee portions. A third and fourth of the pockets is securely coupled to one of the shin portions. Each of a plurality of padding members is removably positionable in one of the pockets such that each of the pockets has one of the padding members therein. A primary strap member removably secures the waist portion to the body of a user. A back side of the primary strap member is securely attached to and extends along a top edge of the waist portion. Each of a plurality of secondary strap members removably secures each of the leg portions to one of the legs of a user. Each of the secondary strap members is securely coupled to one of the first and second leg portions.

In these respects, the protective chaps according to the present invention substantially departs from the conventional concepts and designs of the prior art, and in so doing provides an apparatus primarily developed for the purpose of protecting the shins, knees, feet and chest of a wearer.

SUMMARY OF THE INVENTION

In view of the foregoing disadvantages inherent in the known types of chaps now present in the prior art, the present invention provides a new protective chaps construction wherein the same can be utilized for protecting the shins, knees, feet and chest of a wearer.

The general purpose of the present invention, which will be described subsequently in greater detail, is to provide a new protective chaps apparatus and method which has many of the advantages of the chaps mentioned heretofore and many novel features that result in a new protective chaps which is not anticipated, rendered obvious, suggested, or even implied by any of the prior art chaps, either alone or in any combination thereof.

To attain this, the present invention generally comprises first and second leg portions adapted to fit over trousers of a user. Each of the leg portions has a knee portion, and a shin portion. Each of the leg portions is integrally coupled to and extends away from a waist portion. Each of a plurality of pockets is securely coupled to one of the first and second leg portions. A first and second of the pockets is securely coupled to one of the knee portions. A third and fourth of the pockets is securely coupled to one of the shin portions. Each of a plurality of padding members is removably positionable in one of the pockets such that each of the pockets has one of the padding members therein. A primary strap member removably secures the waist portion to the body of a user. A back side of the primary strap member is securely attached to and extends along a top edge of the waist portion. Each of a plurality of secondary strap members removably secures each of the leg portions to one of the legs of a user. Each of the secondary strap members is securely coupled to one of the first and second leg portions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting, as to the scope of the invention in any way.

It is therefore an object of the present invention to provide a new protective chaps apparatus and method which has many of the advantages of the chaps mentioned heretofore and many novel features that result in a new protective chaps which is not anticipated, rendered obvious, suggested, or even implied by any of the prior art chaps, either alone or in any combination thereof.

It is another object of the present invention to provide a new protective chaps which may be easily and efficiently manufactured and marketed.

It is a further object of the present invention to provide a new protective chaps which is of a durable and reliable construction.

An even further object of the present invention is to provide a new protective chaps which is susceptible of a low cost of manufacture with regard to both materials and labor, and which accordingly is then susceptible of low prices of sale to the consuming public, thereby making such protective chaps economically available to the buying public.

Still yet another object of the present invention is to provide a new protective chaps which provides in the apparatuses and methods of the prior art some of the advantages thereof, while simultaneously overcoming some of the disadvantages normally associated therewith.

Still another object of the present invention is to provide a new protective chaps for protecting the shins, knees, feet and chest of a wearer.

Yet another object of the present invention is to provide a new protective chaps which includes first and second leg portions adapted to fit over trousers of a user. Each of the leg portions has a knee portion, and a shin portion. Each of the leg portions is integrally coupled to and extends away from a waist portion. Each of a plurality of pockets is securely coupled to one of the first and second leg portions. A first and second of the pockets is securely coupled to one of the knee portions. A third and fourth of the pockets is securely coupled to one of the shin portions. Each of a plurality of padding members is removably positionable in one of the pockets such that each of the pockets has one of the padding members therein. A primary strap member removably secures the waist portion to the body of a user. A back side of the primary strap member is securely attached to and extends along a top edge of the waist portion. Each of a plurality of secondary strap members removably secures each of the leg portions to one of the legs of a user. Each of the secondary strap members is securely coupled to one of the first and second leg portions.

Still yet another object of the present invention is to provide a new protective chaps that has chest, groin and foot protectors that may be added to the chaps for protecting a larger portion of the body.

Even still another object of the present invention is to provide a new protective chaps that has a belt for hanging tool and container on.

These together with other objects of the invention, along with the various features of novelty which characterize the invention, are pointed out with particularity in the claims annexed to and forming a part of this disclosure. For a better understanding of the invention its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
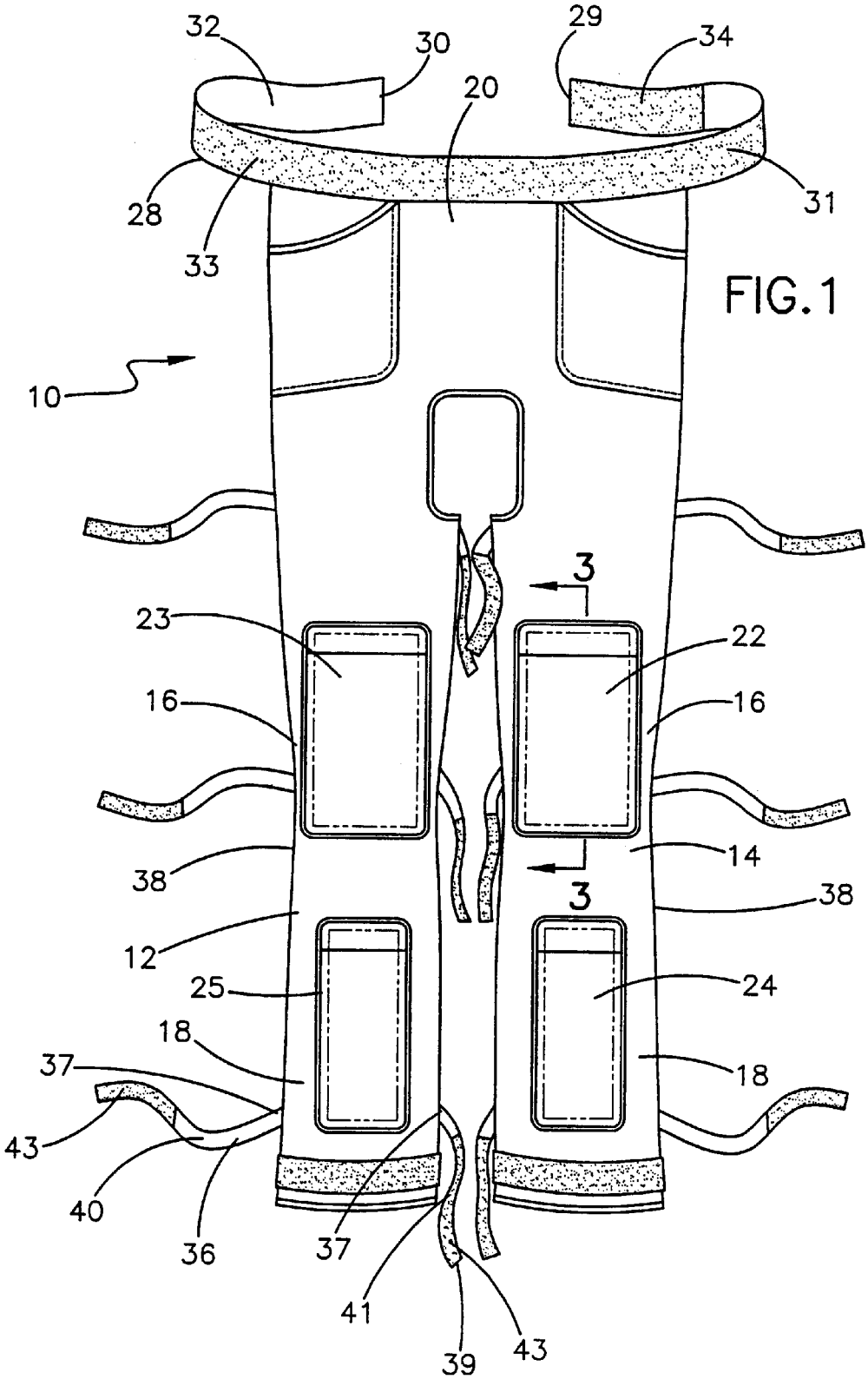
FIG. 1 is a schematic front view of a new protective chaps according to the present invention.
Figure 2:
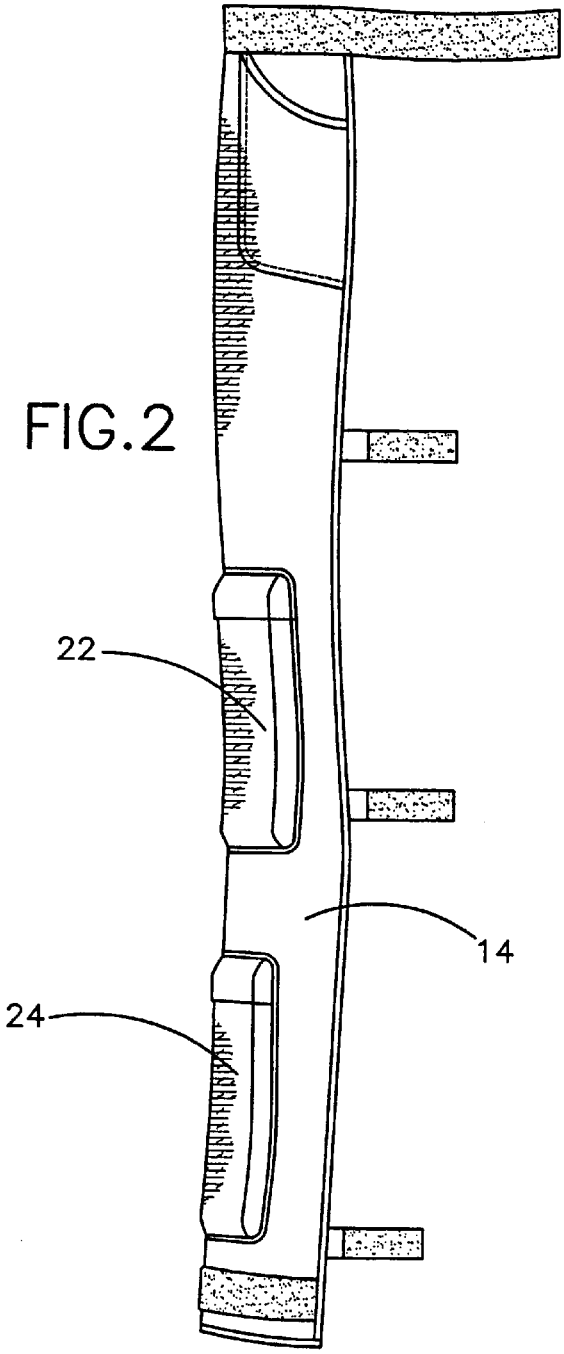
FIG. 2 is a schematic side view of the present invention.
Figure 3:
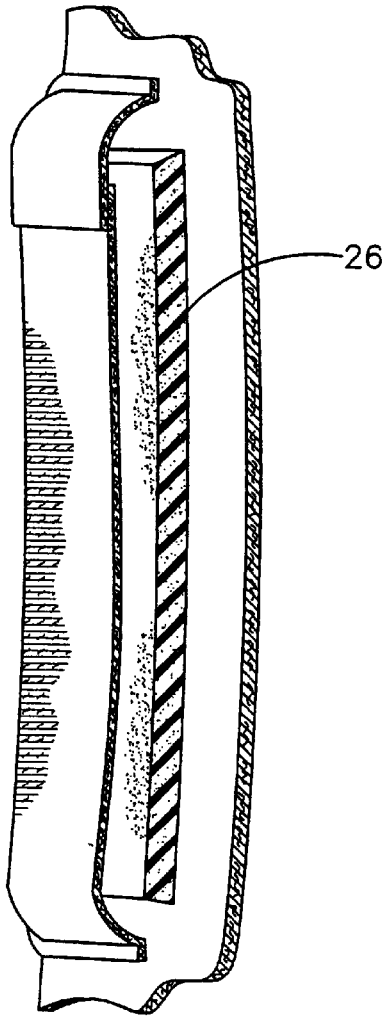
FIG. 3 is a schematic cross-sectional view along 3—3 of the present invention.
Figure 4:
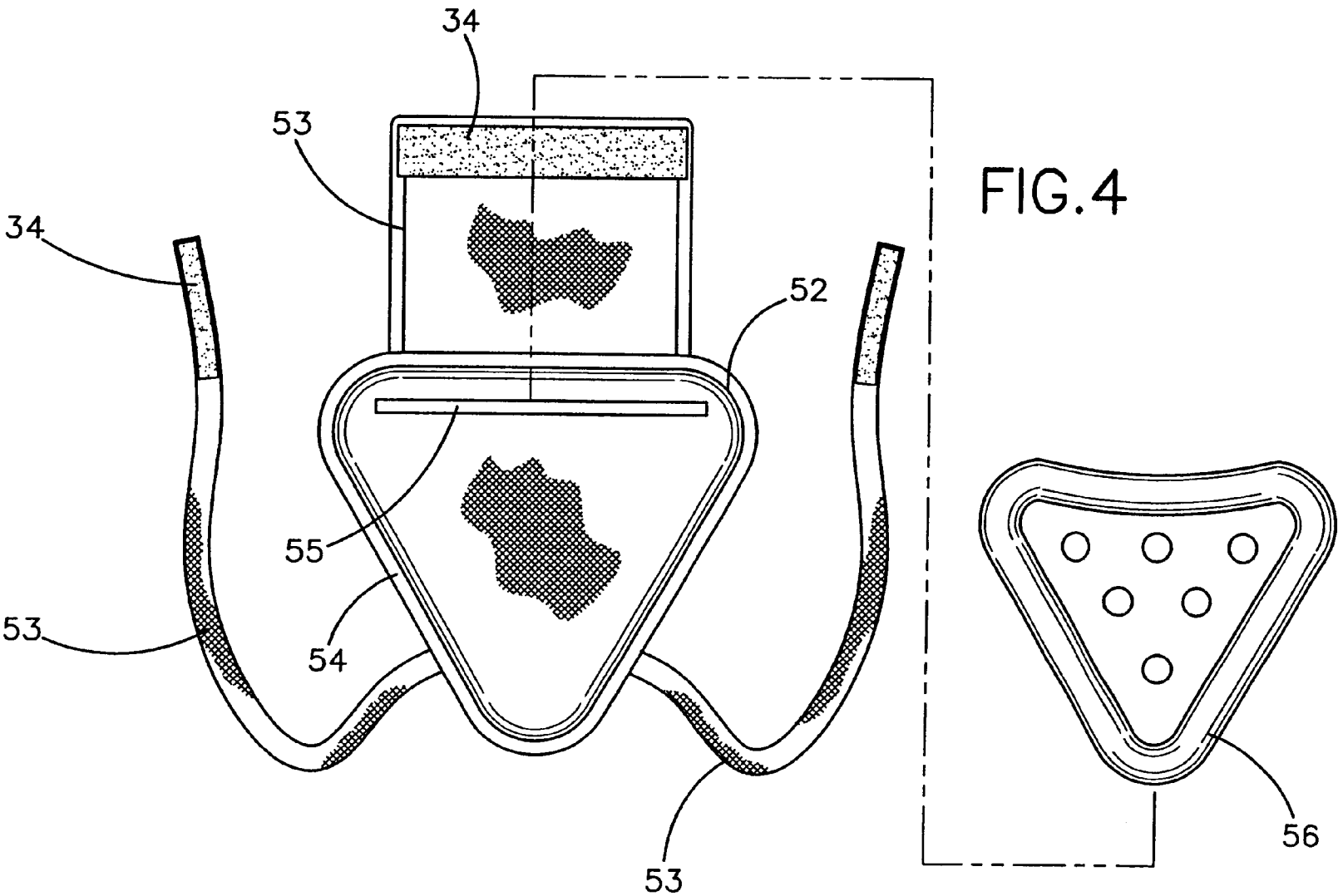
FIG. 4 is a schematic front view of the groin panel of the present invention.
Figures 5, 6:
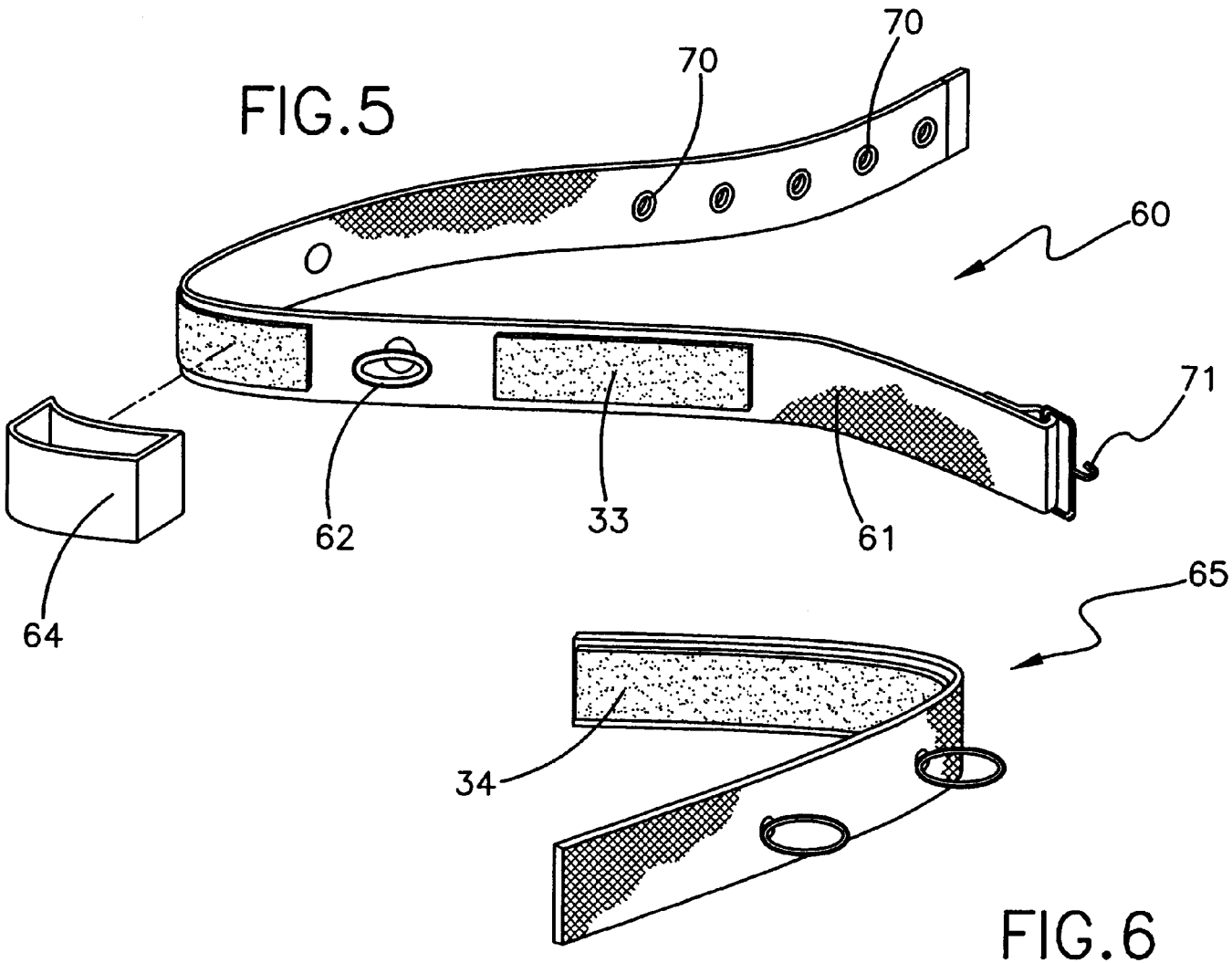
FIG. 5 is a schematic perspective view of a belt of the present invention.
FIG. 6 is a schematic perspective view of a belt of the present invention.
Figures 7, 8:
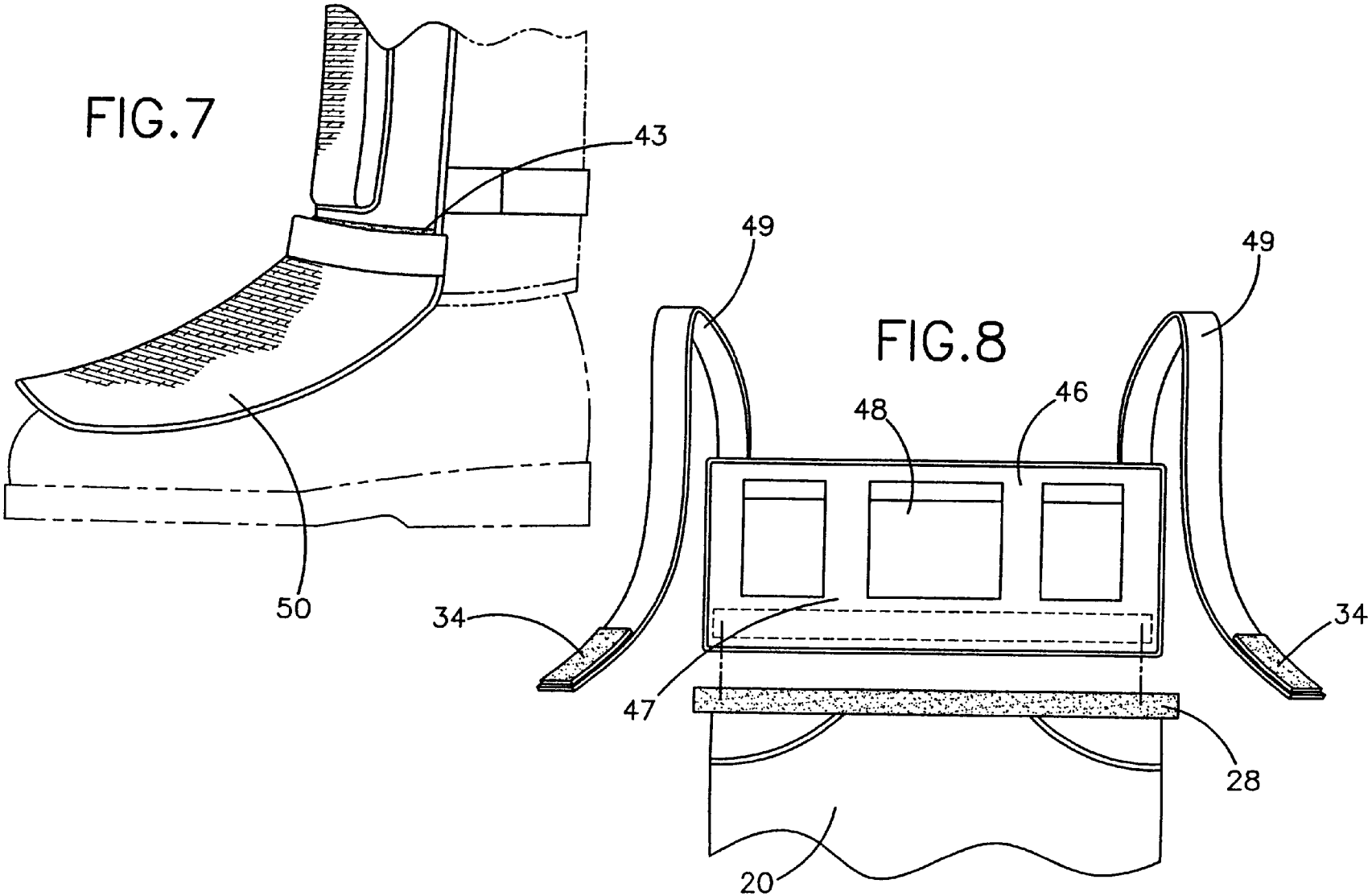
FIG. 7 is a schematic side view of a foot panel of the present invention.
FIG. 8 is a schematic front view of a chest panel of the present invention.

With reference now to the drawings, and in particular to FIGS. 1 through 8 thereof, a new protective chaps embodying the principles and concepts of the present invention and generally designated by the reference numeral 10 will be described.

As best illustrated in FIGS. 1 through 8, the protective chaps 10 generally comprises first 12 and second 14 leg portions adapted to fit over trousers of a user. Each of the leg portions 12, 14 has a knee portion 16, and a shin portion 18. Each of the leg portions 12, 14 is integrally coupled to and extends away from a waist portion 20.

Each of a plurality of pockets is securely coupled to one of the first 12 and second leg 14 portions. A first 22 and second 23 of the pockets is securely coupled to one of the knee 16 portions. A third 24 and fourth 25 of the pockets is securely coupled to one of the shin portions 18.

Each of a plurality of padding members 26 is removably positionable in one of the pockets. Each of the padding members 26 comprises a foamed elastomeric material. Each of the pockets 22–25 has one of the padding members 26 therein.

A primary strap member 28 removably secures the waist portion 20 to the body of a user. The primary strap member 28 is elongate and has a first end 29, a second end 30, a front side 31 and a back side 32. The back side 32 of the primary strap member is securely attached to and extends along a top edge of the waist portion 20. The front side 31 of the primary strap member 28 has a loop portion 33 of a hook and loop securing means securely coupled thereto. A hook portion 34 is securely attached to the back side 32 and positioned generally adjacent to the first end 29 for coupling opposite ends of the primary strap member 28 together.

A plurality of secondary strap members 36 removably secures each of the leg portions 12, 14 to a leg of a user. Each of the secondary strap members 36 has a pair of ends 37 securely coupled to an opposite edge 38 of one of the first 12 and second 14 leg portions. Each of the secondary strap members 36 has a break 39 in therein such that a first member 40 and second member 41 of each of the secondary strap members 36 is defined. Each of the secondary strap members 36 has a hook and loop securing means 43 attached thereto for removably securing together each of the first members 40 to a respective second member 41.

A chest panel 46 has a front side 47 having a plurality of pockets 48 attached thereto. Each one of a pair of straps 49 is securely coupled to a top edge of the chest panel 46. Each of the straps 49 coupled to the chest panel 46 has a hook portion 34 securely attached thereto for removably coupling with the loop portion 33 on the primary strap member 28. Adjacent to the bottom edge of an inner side of the chest panel 46 and extending along the bottom edge is a hook portion for coupling to the primary strap member.

Each of a pair of foot panels 50 is positionable over one of the feet of a user and removably coupled to a respective leg portion 12, 14 with a hook and loop securing means 43.

A groin protection pouch 52 has a generally triangular shape. Each one of three straps 53 is securely coupled to one of the edges 54 of the groin protection pouch 52. Each of the straps 53 coupled to the groin protection pouch 52 has a hook portion 34 securely attached thereto for removably coupling with the loop portion 33 on the primary strap member 28. The groin protection pouch 52 preferably has a slit 55 therein for removably positioning a rigid cup 56 in an interior of the groin protection pouch. The cup 56 having a generally triangular shape and having and outer edge comprising a resiliently flexible material. Each of the leg, waist, chest, foot and groin panels ideally comprises a denim material.

Each of plurality of containers 64 has an outer surface having a hook portion 34 thereon for removably attaching the containers to the loop portion 33 on the front side 31 of the primary strap member 28.

A belt 60 has an outer surface having a loop portion 33 thereon such that the containers 64 may be removably coupled to the belt. The belt 60 has a pair of ends. A fastening member removably fastens ends of the belt 60 together to define a loop. The fastening member preferably includes a plurality of apertures 70 in the belt 60 and a hook 71 coupled to an end of the belt 60 which is removably insertable into the apertures 70, though any conventional clasp may be used. The belt 60 has a plurality of annular members 62 securely coupled thereto.

An elongate flexible member 65 has an inner surface having a hook portion 34 securely attached thereto for removably coupling with the loop portion 33 on the primary strap member 28. An outer surface of the elongated member 65 has a plurality of annular members 62 securely coupled thereto. The containers 64 may hold screws and nails while the annular members may hold tools.

In use, the chaps are worn like conventional chaps. The padding members help protect a user for kneeling and for being struck in the shins. The foot and chest panels may be added for protecting, those areas. The bottom edge of the chest panel is coupled to the primary strap member 28 adjacent to the waist portion 20. The straps 49 are attached to the primary strap member adjacent behind the user when the primary strap member is extended around a user and coupled to itself for holding the chaps on the person.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. Chaps for protecting the body of a user comprising:

first and second leg portions adapted to fit over trousers of a user, each of said leg portions having a knee portion, and a shin portion, each of said leg portions being integrally coupled to and extending away from a waist portion;

a plurality of pockets, each of said pockets being securely coupled to one of said first and second leg portions, a first and second of said pockets being securely coupled to one of said knee portions, a third and fourth of said pockets being securely coupled to one of said shin portions;

a plurality of padding members, each of said padding members being removably positionable in one of said pockets, wherein each of said pockets has one of said padding members therein;

a primary strap member for removably securing said waist portion to the body of a user, a back side of said primary strap member being securely attached to and extending along a top edge of said waist portion, and a plurality of secondary strap members for removably securing each of said leg portions to a leg of a user, each of said secondary strap members being securely coupled to one of said first and second leg portions;

wherein said primary strap member is elongate and having a first end, a second end, a front side and said back side, said front side of said primary strap member having a loop portion of a hook and loop securing means securely coupled thereto, a hook portion being securely attached to said back side and positioned generally adjacent to said first end.

2. The chaps as in claim 1, wherein each of said secondary strap members has a pair of ends securely coupled to an opposite edge of one of said first and second leg portions, each of said secondary strap members having a break in therein such that a first member and second member of each of said secondary strap members is defined, each of said secondary strap members having a hook and loop securing means attached thereto for removably securing together each of said first members to a respective second member.

3. The chaps as in claim 1, further including:

a chest panel, said chest panel having a front side having a plurality of pockets attached thereto, each one of a pair of straps being securely coupled to a top edge of said chest panel, each of said straps coupled to said chest panel having a hook portion securely attached thereto for removably coupling with said loop portion on said primary strap member, said chest panel having a inner side having a hook portion extending along a bottom edge of the chest panel for removably coupling with said loop portion on said primary strap member.

4. The chaps as in claim 3, further including:

a pair of foot panels, each of said foot panels being positionable over one of the feet of a user and removably coupled to a respective leg portion with a hook and loop securing means.

5. The chaps as in claim 1, further including:

a pair of foot panels, each of said foot panels being positionable over one of the feet of a user and removably coupled to a respective leg portion with a hook and loop securing means.

6. The chaps as in claim 3, further including:

a groin protection pouch, said groin protection pouch having a generally triangular shape, each one of three straps being securely coupled to one of the edges of said groin protection pouch, each of said straps coupled to said groin protection pouch having a hook portion securely attached thereto for removably coupling with said loop portion on said primary strap member.

7. Chaps system for protecting legs, chest, and feet of a user comprising:

first and second leg portions adapted to fit over trousers of a user, each of said leg portions having, a knee portion, and a shin portion, each of said leg portions being integrally coupled to and extending away from a waist portion;

a plurality of pockets, each of said pockets being securely coupled to one of said first and second leg portions, a first and second of said pockets being securely coupled to one of said knee portions, a third and fourth of said pockets being securely coupled to one of said shin portions;

a plurality of padding members, each of said padding members being removably positionable in one of said pockets, each of said padding members comprising a foamed elastomeric material, wherein each of said pockets has one of said padding members therein;

a primary strap member for removably securing said waist portion to the body of a user, said primary strap member being elongate and having a first end, a second end, a front side and a back side, said back side of said primary strap member being securely attached to and extending along a top edge of said waist portion, said front side of said primary strap member having a loop portion of a hook and loop securing means securely coupled thereto, a hook portion being securely attached to said back side and positioned generally adjacent to said first end;

a plurality of secondary strap members for removably securing each of said leg portions to a leg of a user, each of said secondary strap members having a pair of ends securely coupled to an opposite edge of one of said first and second leg portions, each of said secondary strap members having a break in therein such that a first member and second member of each of said secondary strap members is defined, each of said secondary strap members having a hook and loop securing means attached thereto for removably securing together each of said first members to a respective second member;

a chest panel, said chest panel having a front side having a plurality of pockets attached thereto, each one of a pair of straps being securely coupled to a top edge of said chest panel, each of said straps coupled to said chest panel having a hook portion securely attached thereto for removably coupling with said loop portion on said primary strap member, said chest panel having a inner side having a hook portion extending along a bottom edge of the chest panel for removably coupling with said loop portion on said primary strap member;

a pair of foot panels, each of said foot panels being positionable over one of the feet of a user and removably coupled to a respective leg portion with a hook and loop securing means;

a groin protection pouch, said groin protection pouch having a generally triangular shape, each one of three straps being securely coupled to one of the edges of said groin protection pouch, each of said straps coupled to said groin protection pouch having a hook portion securely attached thereto for removably coupling with said loop portion on said primary strap member;

each of said leg, waist, chest, foot and groin panels comprising a denim material; and a plurality of containers, each of said containers having an outer surface having a hook portion thereon for removably attaching said containers to said loop portion on said front side of said primary strap member.

8. The chaps system as in claim 7, further including:

a belt, said belt having an outer surface having a loop portion thereon such that said containers may be removably coupled to said belt, said belt having a pair of ends, a fastening member removably fastens said belt together to define a loop, said belt having a plurality of annular members securely coupled thereto.

9. The chaps system as in claim 8, further including:

an elongate flexible member having an outer surface having a plurality of annular members coupled thereto and an inner surface having a hook portion securely attached thereto for removably coupling with said loop portion on said primary strap member.

10. The chaps system as in claim 7, further including:

an elongate flexible member having an outer surface having a plurality of annular members coupled thereto and an inner surface having a hook portion securely attached thereto for removably coupling with said loop portion on said primary strap member.

11. Chaps for protecting the body of a user comprising:

first and second leg portions adapted to fit over legs of a user, each of said leg portions having a knee portion, and a shin portion, each of said leg portions being coupled to and extending away from a waist portion, a plurality of pockets, each of said pockets being coupled to one of said first and second leg portions, a first and second of said pockets being coupled to one of said knee portions, a third and fourth of said pockets being coupled to one of said shin portions;

a plurality of padding members, each of said padding members being removably positioned in one of said pockets;

a primary strap member for removably securing said waist portion to the body of a user, said primary strap member being attached to and extending along a top edge of said waist portion, and a plurality of secondary strap members for removably securing each of said leg portions to one of the legs of a user, each of said secondary strap members being coupled to one of said first and second leg portions:

wherein said primary strap member is elongate and has a first end, a second end, and opposite sides, a first one of said sides of said primary strap member having a loop portion of a hook and loop securing, means coupled thereto, a second one of said sides of said primary strap member having a hook portion of the hook and loop securing means being attached thereto.

12. The chaps as in claim 1, wherein each of said secondary strap members has a pair of ends coupled to an opposite edge of one of said first and second leg portions, each of said secondary strap members having a break therein such that a first member and second member of each of said secondary strap members is defined, each of said secondary strap members having a hook and loop securing means attached thereto for removably securing together each of said first members to a respective second member.

13. The chaps as in claim 11, further including a chest panel having a front side with a plurality of pockets attached thereto, each one of a pair of straps being coupled to a top edge of said chest panel, each of said straps coupled to said chest panel having a hook portion securely attached thereto for removably coupling with said loop portion on said primary strap member, said chest panel having a inner side having a hook portion extending along a bottom edge of the chest panel for removably coupling with said loop portion on said primary strap member.

14. The chaps as in claim 13, further including a pair of foot panels, each of said foot panels being positionable over one of the feet of a user and removably coupled to a respective leg portion with a hook and loop securing means.

15. The chaps as in claim 11, further including a pair of foot panels, each of said foot panels being positionable over one of the feet of a user and removably coupled to a respective leg portion with a hook and loop securing means.

16. The chaps as in claim 13, further including a groin protection pouch having a generally triangular shape, each one of three straps being coupled to one of the edges of said groin protection pouch, each of said straps coupled to said groin protection pouch having a hook portion attached thereto for removably coupling with said loop portion on said primary strap member.

* * * * *